US007273146B2

(12) United States Patent
Brown

(10) Patent No.: US 7,273,146 B2
(45) Date of Patent: Sep. 25, 2007

(54) CONTAINER WHOSE SIDE WALL INCLUDES A SURFACE DISCONTINUITY TO HOLD SHRINKWRAP THERETO

(75) Inventor: Dean R. Brown, Beaverton, MI (US)

(73) Assignee: PWP Industries Corporation, Vernon, CA (US)

( * ) Notice: Subject to any disclaimer, the term of this patent is extended or adjusted under 35 U.S.C. 154(b) by 99 days.

(21) Appl. No.: 10/090,885

(22) Filed: Mar. 4, 2002

(65) Prior Publication Data

US 2002/0157984 A1 Oct. 31, 2002

Related U.S. Application Data

(60) Provisional application No. 60/273,491, filed on Mar. 5, 2001.

(51) Int. Cl.
*B65D 65/00* (2006.01)

(52) U.S. Cl. ..... 206/497; 206/217; 40/306

(58) Field of Classification Search ..... 206/521, 206/217, 432, 497, 770; 40/310, 306, 324; 220/672; D7/523
See application file for complete search history.

(56) References Cited

U.S. PATENT DOCUMENTS 2,563,352 A * 8/1951 Morse ..... 206/515
3,235,112 A * 2/1966 Fillwalk et al.
3,386,846 A * 6/1968 Lones ..... 428/42.3
3,885,671 A 5/1975 Spiegel et al.
3,927,484 A * 12/1975 Spiegel et al.
3,976,795 A * 8/1976 Ando
4,018,904 A * 4/1977 Muraoka
4,102,454 A * 7/1978 Karevaara ..... 206/514
4,130,201 A 12/1978 Duerr
4,183,441 A * 1/1980 Erlandson
4,205,750 A * 6/1980 Dews ..... 206/534
4,475,651 A * 10/1984 Elsner
4,708,242 A 11/1987 Reid et al.
4,873,814 A 10/1989 Harris
5,119,965 A 6/1992 Arduca et al.
5,489,126 A * 2/1996 Gray, Jr.
5,495,944 A 3/1996 Lermer
5,605,230 A * 2/1997 Marino, Jr. et al.
D381,259 S 7/1997 Hayes
5,866,181 A * 2/1999 Hill ..... 426/107
5,931,323 A * 8/1999 Wilkinson et al.
5,985,387 A * 11/1999 Mori et al. ..... 428/34.9
6,247,612 B1 * 6/2001 Kaufman ..... 221/312 C
D457,783 S * 5/2002 Bodum ..... D7/511

(Continued)

*Primary Examiner*—David Fidei
(74) *Attorney, Agent, or Firm*—Kagan Binder, PLLC

(57) ABSTRACT

A container having a shrinkwrap layer. The tapered container side wall includes a surface discontinuity which maintains the shrinkwrap in place against the container side wall(s) after the shrinkwrap has been substantially separated from the lid and rim of the container. Whether the shrinkwrap layer minimally hangs over the lid of the unopened container, or whether it entirely covers the lid, the shrinkwrap nonetheless clings to the side wall(s) after the shrinkwrap is torn and separated from the lid and rim of the container. Various configurations of the surface discontinuity are disclosed, such as a ridge extending around the lower periphery of the side wall, a bulge extending around the side wall, a series of indentations or a series of protuberances disposed about the side wall of the container. Further, the inventive surface discontinuity can be employed in a variety of container shapes and sizes.

7 Claims, 14 Drawing Sheets

U.S. PATENT DOCUMENTS 6,385,878 B1 * 5/2002 Key ..... 40/306
D461,368 S * 8/2002 Durand ..... D7/523
6,581,972 B2 * 6/2003 Nojima et al. ..... 283/81
2001/0006165 A1 * 7/2001 Rashid

* cited by examiner

CONTAINER WHOSE SIDE WALL INCLUDES A SURFACE DISCONTINUITY TO HOLD SHRINKWRAP THERETO

This application claims priority benefit of U.S. Provisional Application No. 60/273,491 filed Mar. 5, 2001, the entirety of which is incorporated herein by reference for all purposes.

FIELD OF THE INVENTION

This invention relates to packaging for storing or transporting food or other items. More particularly, the invention relates to a container sealed in shrinkwrap, the container having a sidewall which includes a surface discontinuity which retains the shrinkwrap to the side wall after the shrinkwrap is torn.

BACKGROUND OF THE INVENTION

Due to their relatively low cost, lid and container assemblies made from polymeric materials such as polyester or polyethylene are particularly useful for packaging food stuffs and other such items. As a typical example in the packaged food industry, food items are packed within a thin plastic container whose side walls taper from top to bottom. A lid is provided that releasably engages the container top. To maintain freshness and to prevent tampering with the container contents, a layer of shrinkwrap is formed around the container, usually enveloping the side walls and all or a portion of the container top. The food contents of the container are often pre-arranged into an attractive display, such that the package is ready for serving after opening without any labor required of the consumer. In the assembly process, affixing a label to the side wall of the container can be time-consuming and increases assembly and material costs. To reduce the costs of assembly and eliminate the need for adhesive, the label may be placed between the container side wall and the shrinkwrap before shrinking the shrinkwrap layer. After the shrinkwrap is shrunk, the label is sufficiently held in place until the container is opened.

The type of container-lid-shrinkwrap arrangement just described can be undesirable because the shrinkwrap layer typically falls from the container side wall(s) after it is torn from the top, especially in a container whose side walls taper from top to bottom. In such instance, the label becomes loose and thus discarded or lost. This is undesirable when the label contains important food preparation instructions, e.g., instructions for re-heating. One way to avoid this problem is to adhesively affix the label to the container before shrink wrapping, but such involves extra material (adhesive) and a more costly label. Another problem is that once the shrinkwrap falls from the container side walls, it, too, must often be discarded. In many instances, however, it would be desirable to utilize the original shrinkwrap layer to reseal the container when saving leftover food items. This would save time re-wrapping and would avoid wasting a new sheet of plastic wrap.

Containers sealed in shrinkwrap are well-known in the art and various examples thereof can be found in U.S. Pat. No. 3,885,671; Des. 381,259; U.S. Pat. Nos. 4,708,242 and 5,495,944. U.S. Pat. No. 3,885,671 discloses a container having a shrinkwrap tube which is adhesively secured to a backing card with a hole in it for hanging on a display. However, the shrinkwrap disclosed in the '671 patent does not enclose nor seal the container cap. U.S. Pat. No. 4,708,242 teaches a method of stretch-wrapping various articles.

Des. 381,259 discloses a container whose cap and body are enveloped in a shrinkwrap layer and whose cap is formed with an indentation. U.S. Pat. No. 5,495,944 discloses a tamper-proof container wherein a frangible label and shrinkwrap are adhered to the container side wall such that tampering ruptures the label and thus provides evidence of possible tampering.

None of the aforementioned containers address the problem of the shrinkwrap falling from the container side walls after initially tearing the shrinkwrap. Indeed, in most prior art container designs, the shrinkwrap is merely provided to prevent tampering with the container before it is purchased. The shrinkwrap is intended to be discarded after the consumer first opens the package.

It would be desirable, therefore, to provide an economical container-lid-shrinkwrap combination in which the shrinkwrap adheres to the container side walls after the container is opened.

SUMMARY OF THE INVENTION

The present invention provides a container sealed in shrinkwrap in which the shrinkwrap adheres to the container side wall after the shrinkwrap has been torn and separated from the lid and rim of the container and the lid has been opened. The side wall of the container includes a surface discontinuity which retains the shrinkwrap to the side wall. Adhesives are unnecessary.

In one form, the present invention provides a container for storing items, comprising a container bottom and a side wall extending upward from the bottom and terminating in a rim which defines the periphery of the container. A lid covers the container and engages the rim. The side wall further comprises a surface discontinuity disposed intermediate the rim and the bottom. A layer of shrinkwrap is foamed to at least a portion of the side wall and the lid, the layer of shrinkwrap formed to and covering the surface discontinuity and conforming to the shape thereof.

In another form thereof, the present invention provides a method of sealing a container with a shrinkwrap layer. A container is produced having a bottom, at least one side wall, an open rim and a lid that releasably engages the rim. A surface discontinuity is formed on the side wall. Then, at least a portion of the side wall and the lid are enveloped with a layer of shrinkwrap and the layer is shrunk to the container such that the layer of shrinkwrap covers the surface discontinuity and conforms to the shape thereof.

In a preferred form, the method further comprises the steps of tearing the shrinkwrap layer such that a tear in the shrinkwrap extends down the side wall and the shrinkwrap layer is substantially separated from the container lid and rim, wherein the shrinkwrap substantially adheres to the side wall but the lid can be opened or removed, In another preferred form, the method further comprises placing an adhesive-free label against the side wall before shrinking the shrinkwrap layer to the container.

One advantage of the present invention is that it eliminates the need for adhesives to maintain the shrinkwrap layer to the side wall of the container after the container has been opened. The concomitant cost of adhesive and labor to apply it are therefore also eliminated.

Another advantage of the present invention is that it allows a label to be maintained between the shrinkwrap layer and container side wall without adhesive, even after the shrinkwrap layer is separated from the top of the container. Such is useful when, for example, cooking or storage instructions are printed on the label. By contrast, in prior art configurations, the shrinkwrap layer typically falls from the container side walls after being separated from the container top. Thus, the label, if placed between the shrinkwrap and container without adhesive, is either lost or discarded along with the shrinkwrap.

Yet another advantage of the present invention is that it allows a label to be adhesively applied to the outside of the shrinkwrap layer after shrinking as a final and optional process step. Since the shrinkwrap layer will not fall from the container side wall(s) after it is separated from the container top, there is little problem associated with the label being lost or discarded after the container is first opened.

BRIEF DESCRIPTION OF THE DRAWINGS

The above-mentioned and other advantages of the present invention, and the manner of attaining them, will become more apparent and the invention itself will be better understood by reference to the following description of the embodiments of the invention taken in conjunction with the accompanying drawings, wherein.

DETAILED DESCRIPTION OF THE PRESENTLY PREFERRED EMBODIMENTS

The embodiments of the present invention described below are not intended to be exhaustive or to limit the invention to the precise forms disclosed in the following detailed description. Rather, the embodiments are chosen and described so that others skilled in the art may appreciate and understand the principles and practices of the present invention.

Figure 1:
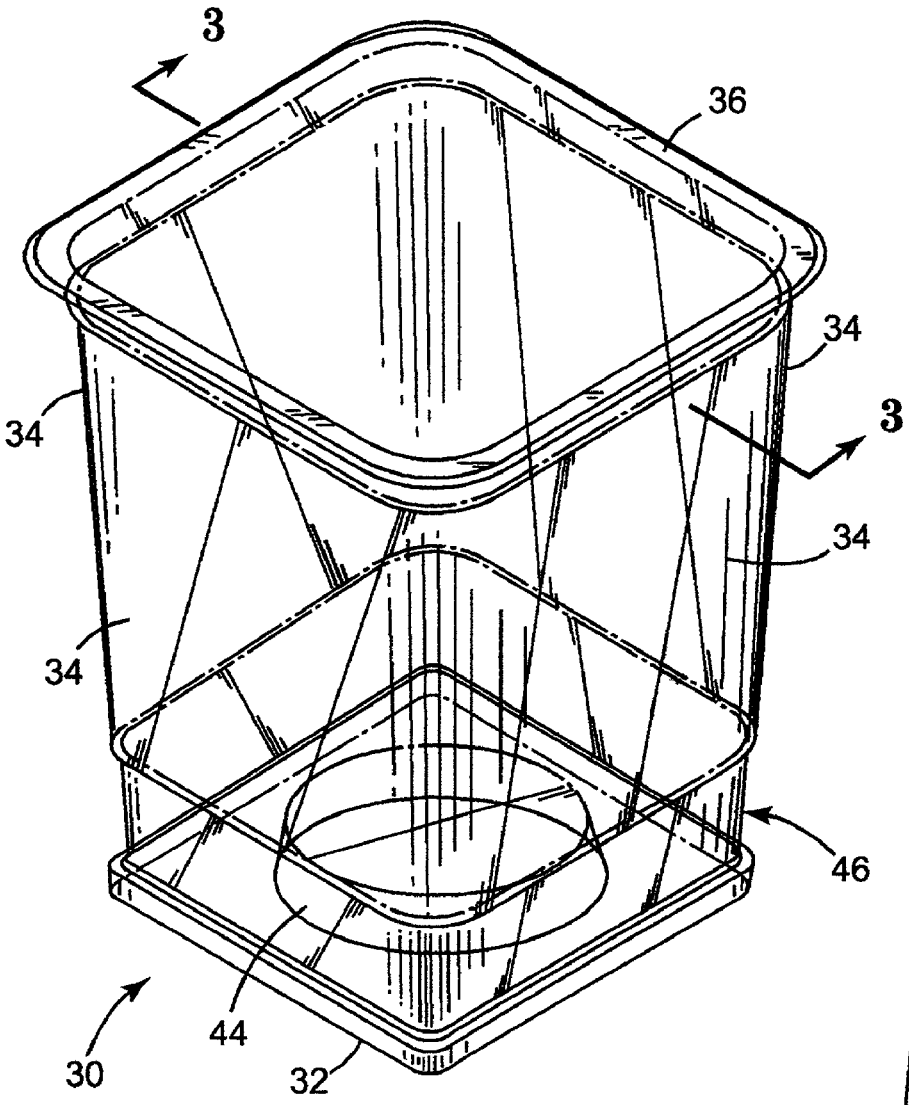
FIG. 1 is a perspective view of an open container in accordance with the present invention.
Figure 2:
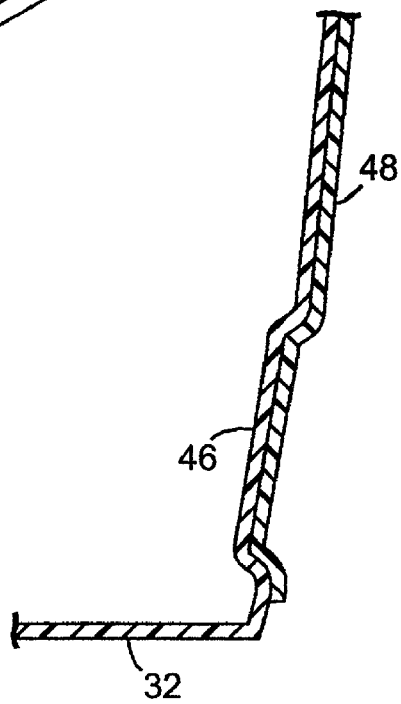
FIG. 2 is a fragmentary cross-sectional view of a lower portion of the container of FIG. 1, illustrating an inventive feature which maintains the shrinkwrap to the container side wall after the shrinkwrap is torn from the top of the container.
Figure 3:
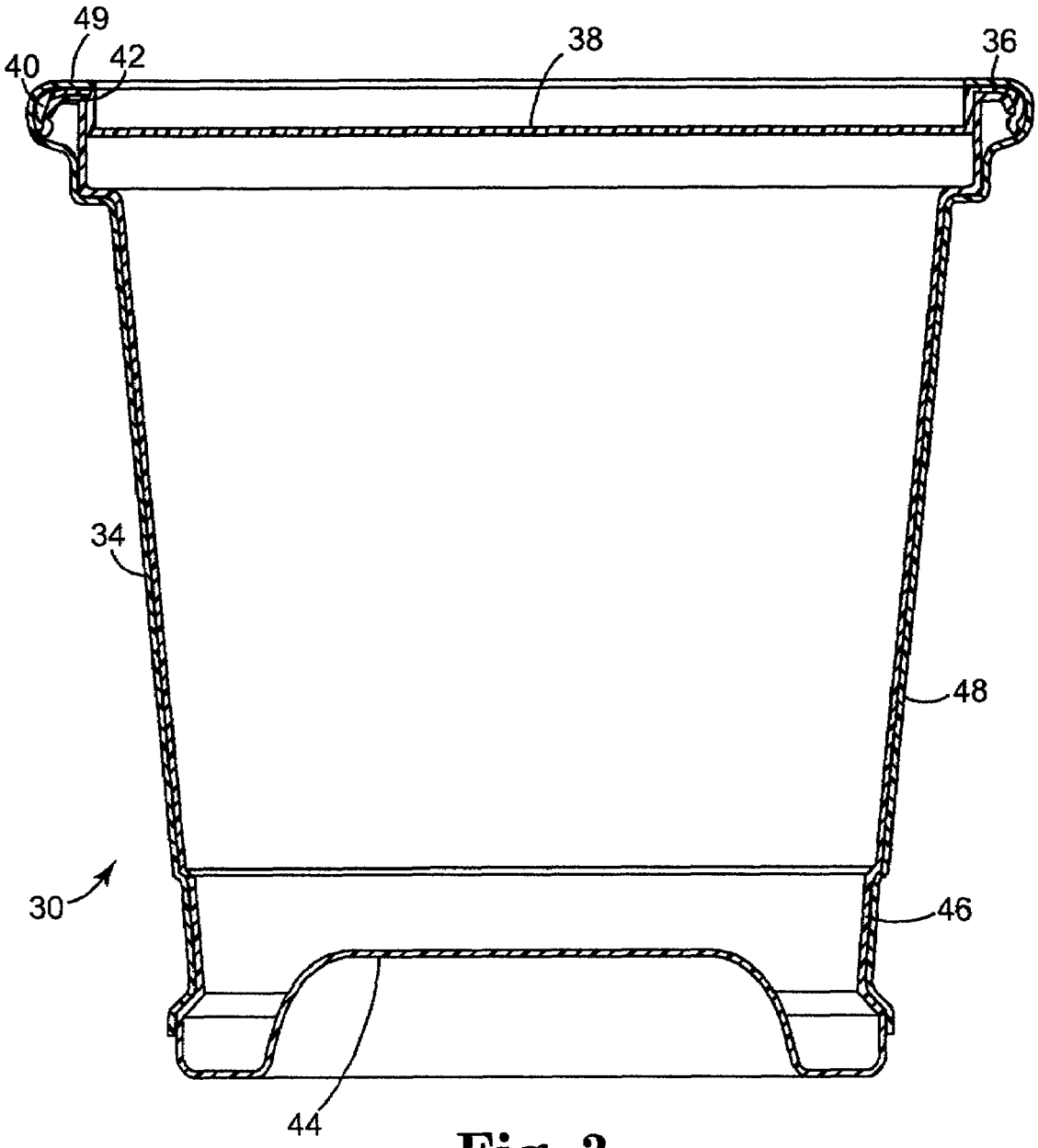
FIG. 3 is a cross sectional view taken along line 3-3 of FIG. 1, except that, unlike FIG. 1, FIG. 3 also depicts the shrinkwrap layer and lid for the container.
Figure 4:
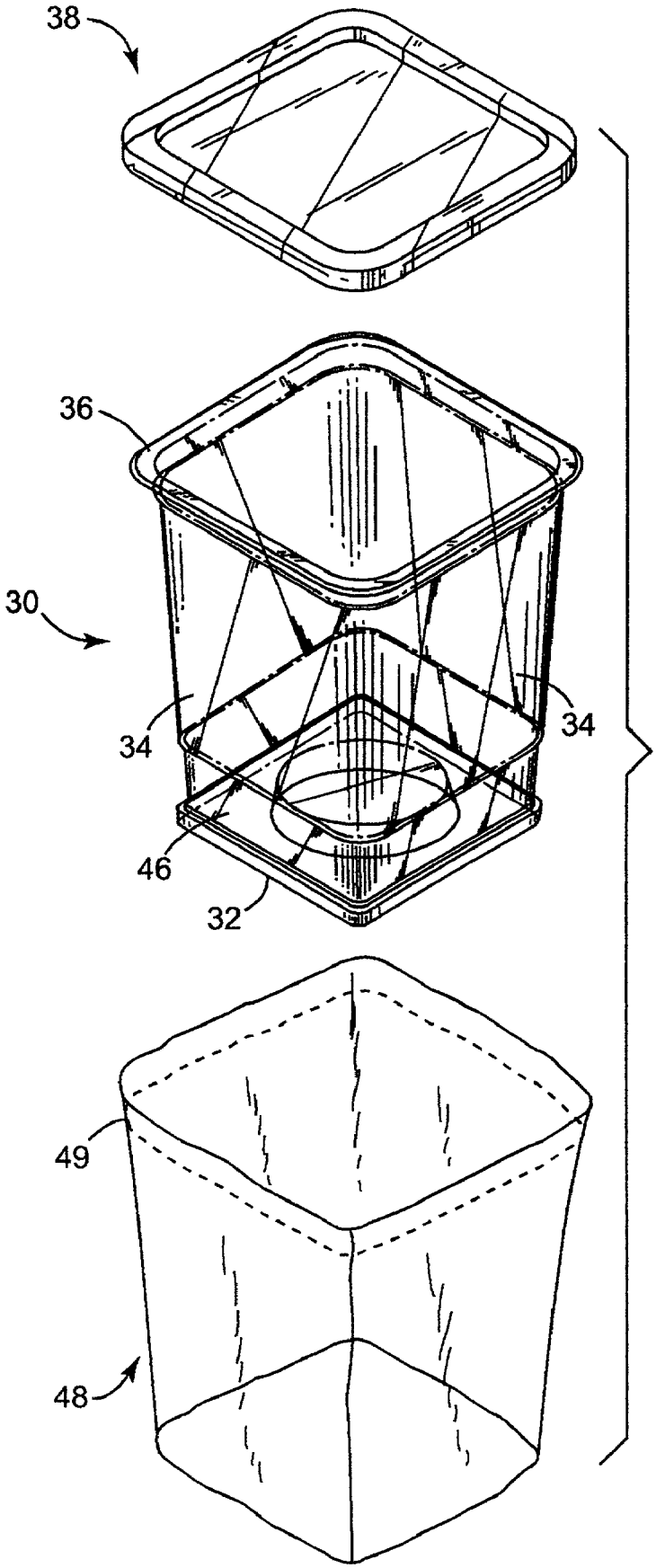
FIG. 4 is an exploded perspective view of the container of FIG. 1, also illustrating the lid and shrinkwrap layer therefor.

FIGS. 1-4 show one preferred embodiment of a container 30 of the present invention. Container 30 includes a container bottom 32 and four taped side walls 34 extending upward from bottom 32 and terminating in rim 36 which defines the substantially square periphery of container 30. Side walls 34 taper from top to bottom, which helps facilitate nesting of several containers. As shown in FIGS. 3 and 4 (but omitted from FIG. 1 for clarity) container 30 includes a lid 38 which covers container 30 and engages rim 36. As seen in FIG. 3, lid 38 includes a resilient C-shaped ledge 40 which wraps around and releasably engages mating ledge 42 defined by rim 36 of container 30. Such engagement between lid and container is well-known in the art and need not be described in further detail here. As shown in FIG. 1, bottom 32 of container 30 includes a raised round mound 44 which facilitates nesting of several containers 30 and adds structural integrity to the container body. Container 30 and lid 38 can be formed from a variety of commercially available plastic materials such as polyethylene, polypropylene, and the like.

With further reference to FIGS. 1-4, container 30 includes a surface discontinuity shown as ridge 46. Ridge 46 is essentially a continuous indentation that extends around the lower portion of the side walls 34 of container 30. As discussed in further detail below, however, the surface discontinuity may take forms other than the ridge depicted in FIGS. 1-4. Further, although it is shown disposed toward the bottom of side walls 34, ridge 46 may be formed in any position on side walls 34 intermediate rim 36 and container bottom 32.

Turning now to FIG. 4, shrinkwrap layer 48 preferably is provided in a single piece tube to envelop and form to the outer periphery of lid 38 and side walls 34 of container 30 after lid 38 is installed on container 30.

The process for shrinking shrinkwrap layer 48 onto container 30 may involve application of heat, pressure and/or vacuum, as is known in the art. As shown in FIGS. 3 and 4, overhang portion 49 of shrinkwrap layer 48 is sized to terminate essentially at the edges of ledges 40 and 42, although other sizes of shrinkwrap layer 48 are possible and will be illustrated below. Significantly, it has been found that when shrinkwrap layer 48 is formed to the contours of ridge 46 as shown in FIG. 2, a sufficiently strong engagement therebetween is made such that shrinkwrap layer 48 remains in position against or otherwise clings to tapered side walls 34 even after portions of layer 48 are torn and or removed from the top of container 30. The surface discontinuity prevents vertical movement of the shrinkwrap layer after it is torn, which in turn keeps it snug against the side walls, which further in turn prevents it from falling from the side walls. This has advantages which are described below.

Figure 5:
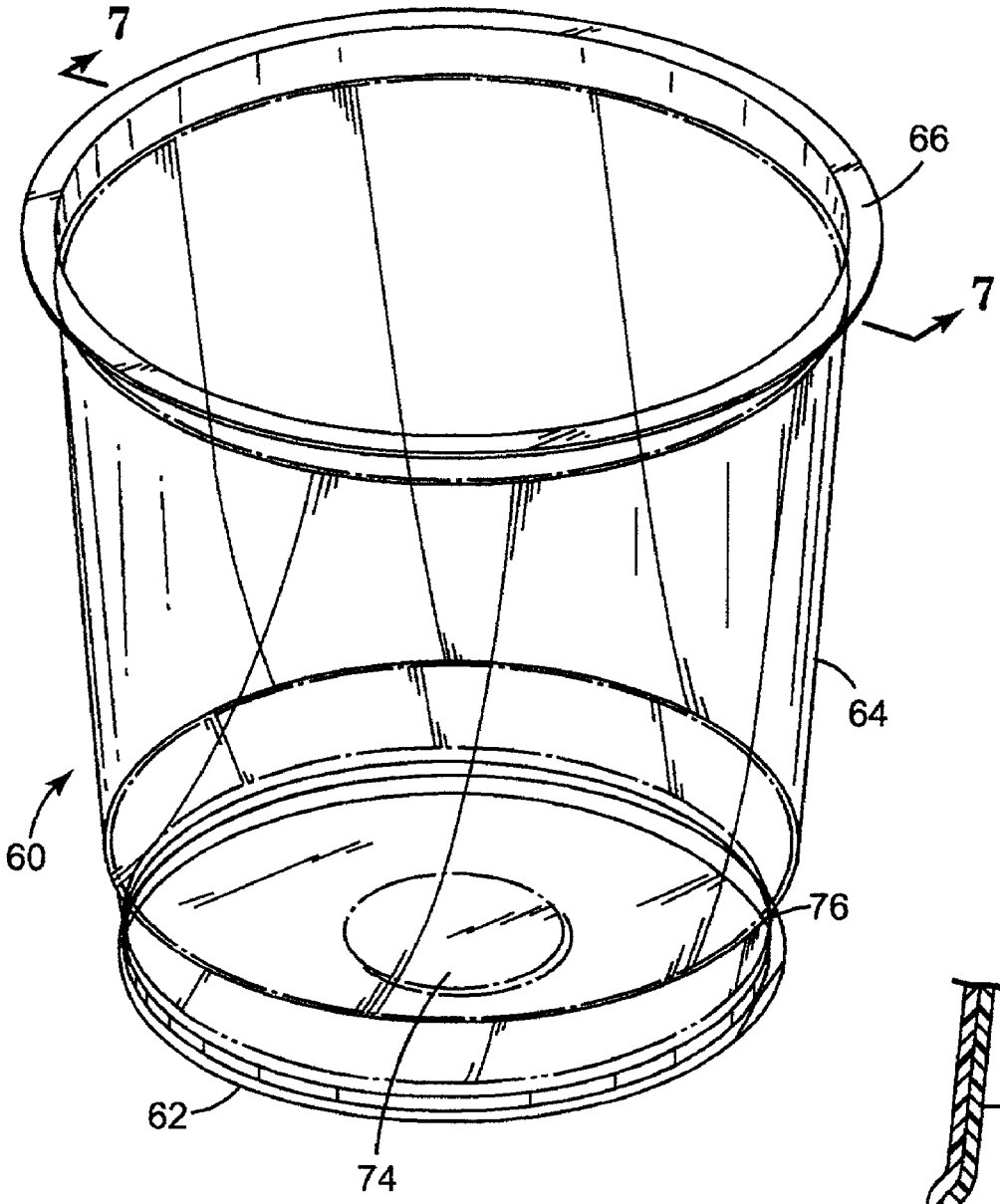
FIG. 5 is a perspective view of an open container in accordance with a second embodiment of the present invention.
Figure 6:
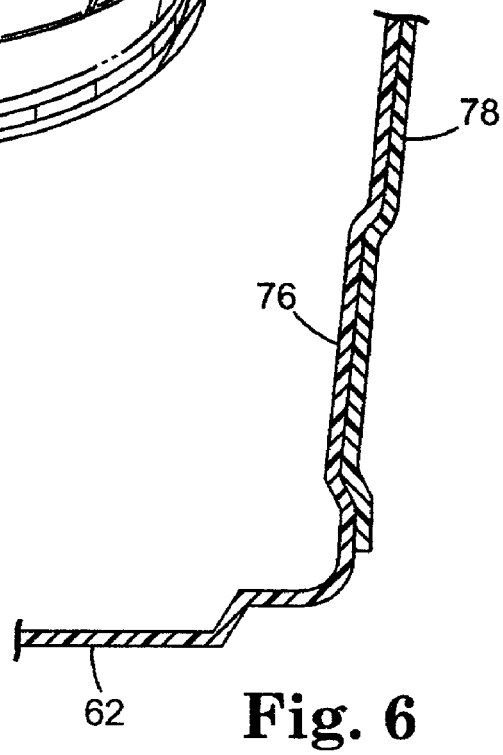
FIG. 6 is a fragmentary cross-sectional view of a lower portion of the container of FIG. 5 with a shrinkwrap layer formed thereto.
Figure 7:
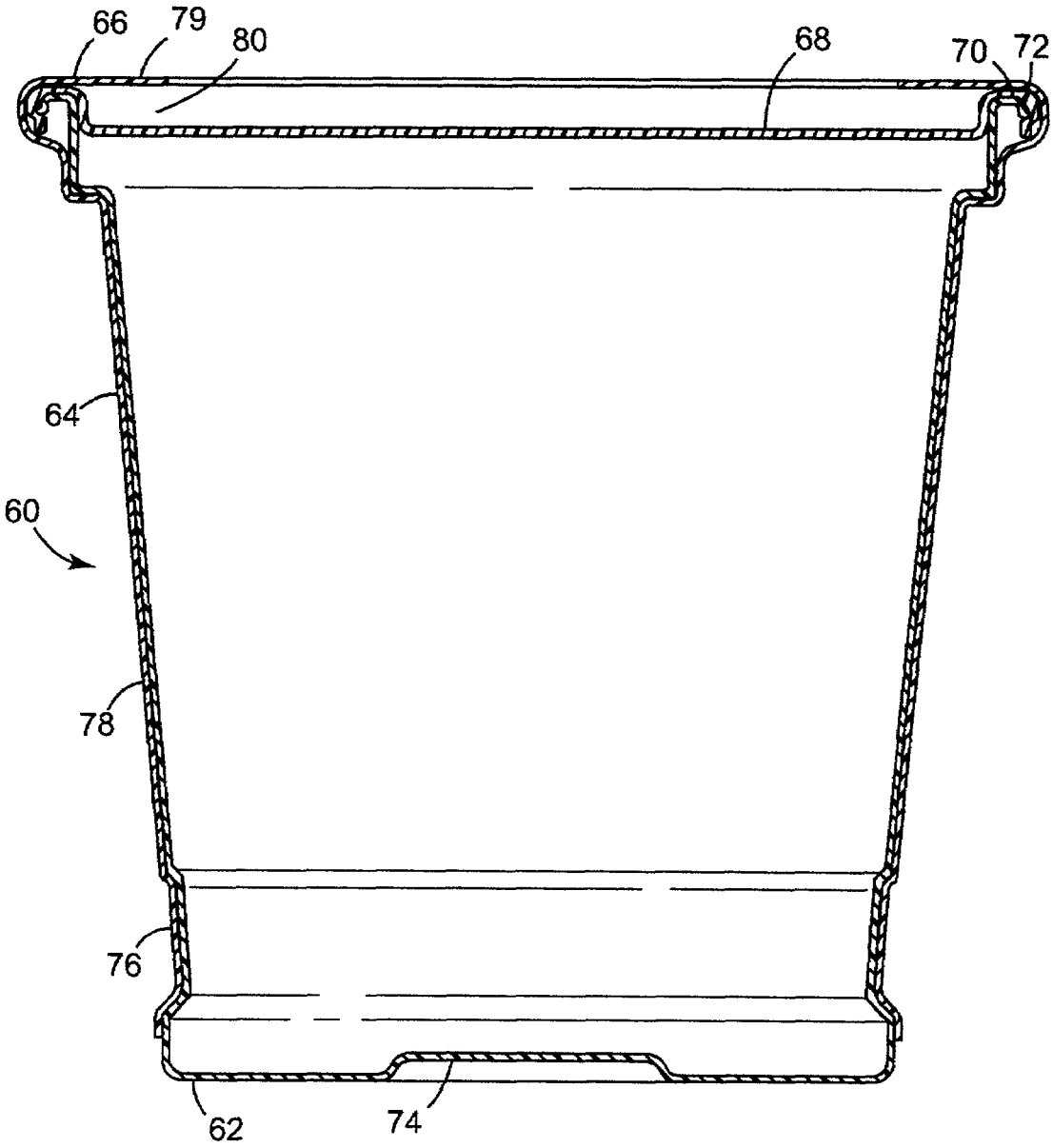
FIG. 7 is a cross sectional view taken along line 7-7 of FIG. 5, except that, unlike the container shown in FIG. 5, FIG. 7 also depicts the shrinkwrap layer and lid for the container.
Figure 8:
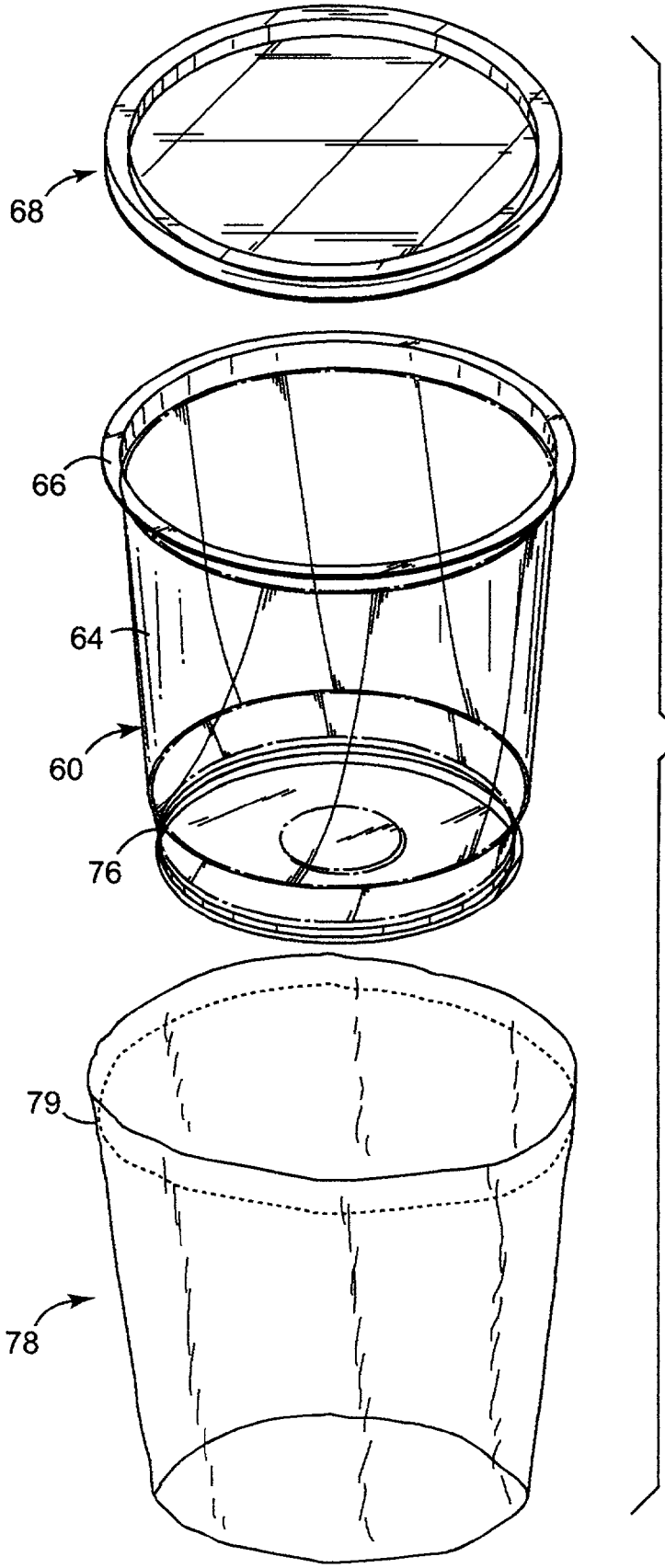
FIG. 8 is an exploded perspective view of the container of FIG. 5, also illustrating the lid and shrinkwrap layer therefor.

A second embodiment is depicted in FIGS. 5-8, wherein container 60 has a substantially round bottom 62 and side wall 64, side wall 64 tapering from top to bottom. As with the embodiment described with reference to FIGS. 1-4, container 60 shown in FIGS. 5-8 includes a rim 66 which defines the periphery of container 60. As shown in FIGS. 7 and 8 (but omitted from FIG. 5 for clarity), container 60 includes a lid 68 which covers container 60 and engages rim 66. As seen in FIG. 7, lid 68 includes a resilient C-shaped ledge 70 which wraps around and releasably engages mating ledge 72 defined by rim 66 of container 60. As shown in FIG. 5, bottom 62 of container 60 includes a raised round mound 74 which allows several containers 60 to be nested and adds structural integrity to the container body. The surface discontinuity of container 60 is shown as ridge 76, which is essentially a continuous indentation that extends around the lower portion of the side walls 64 of container 60. Turning now to FIG. 8, tube-shaped shrinkwrap layer 78 envelops and forms to the outer contours of lid 68 and container 60. Shrinkwrap layer 78 includes a sufficiently large overhang portion 79 as shown in FIGS. 7 and 8 such that shrinkwrap layer 78 can be easily torn from the top of container 60 by inserting one or more fingers in space 80 (FIG. 7) and pulling. As with the substantially square container 30 of FIGS. 1-4, ridge 76 of container 60 helps hold shrinkwrap layer 78 in position against tapered side wall 64 even after shrinkwrap 78 is torn from the top of container 60.

Figure 9:
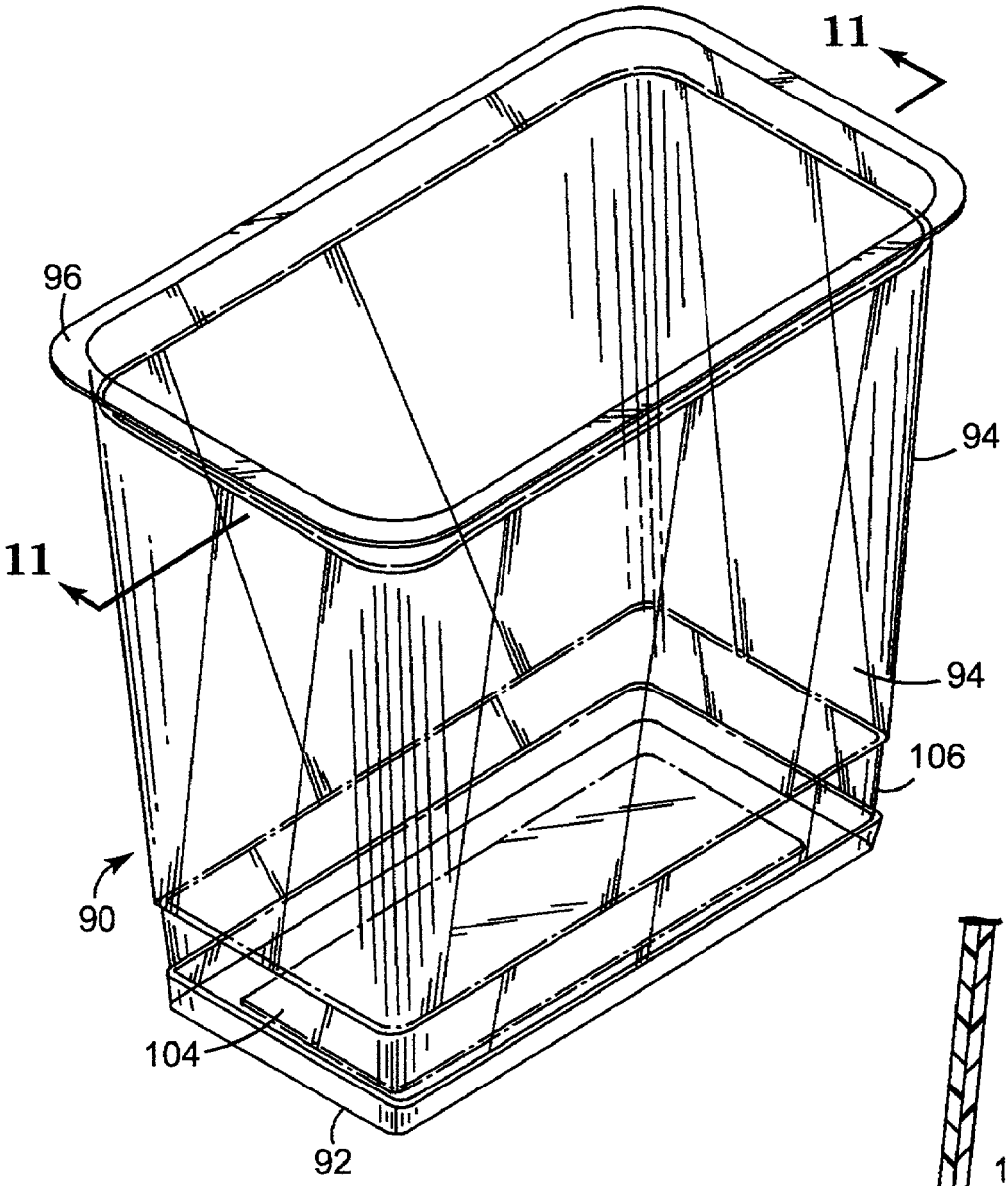
FIG. 9 is a perspective view of an open container in accordance with a third embodiment of the present invention.
Figure 10:
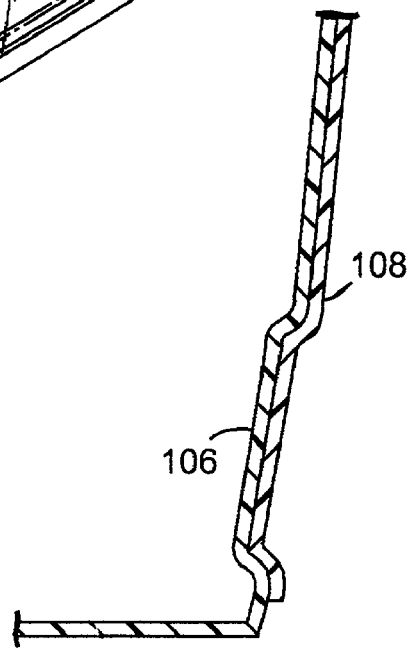
FIG. 10 is a fragmentary cross-sectional view of a lower portion of the container of FIG. 9 with a shrinkwrap layer formed thereto.
Figure 11:
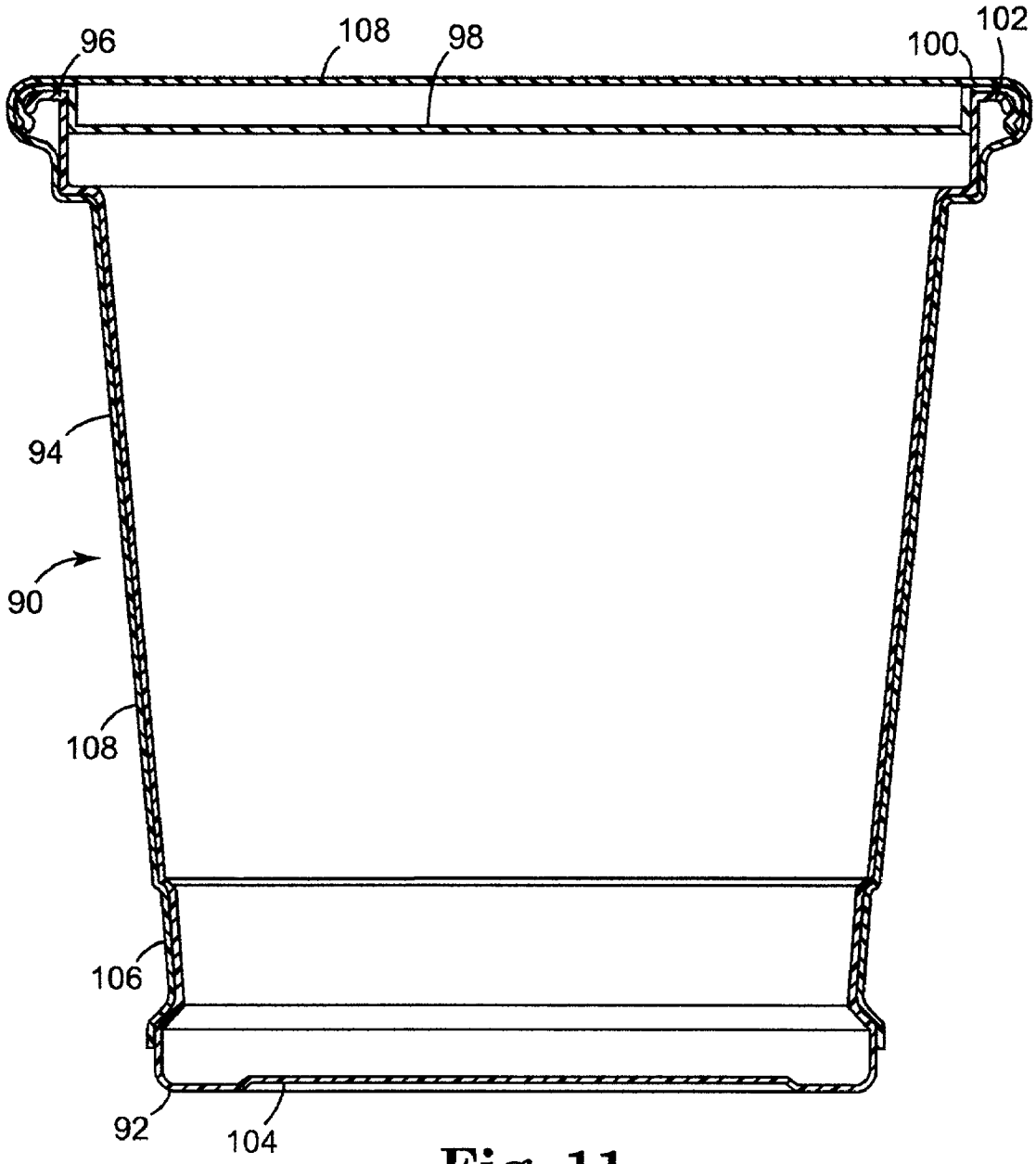
FIG. 11 is a cross sectional view taken along line 11-11 of FIG. 9, except that, unlike FIG. 9, FIG. 11 also depicts the shrinkwrap layer and lid for the container.
Figure 12:
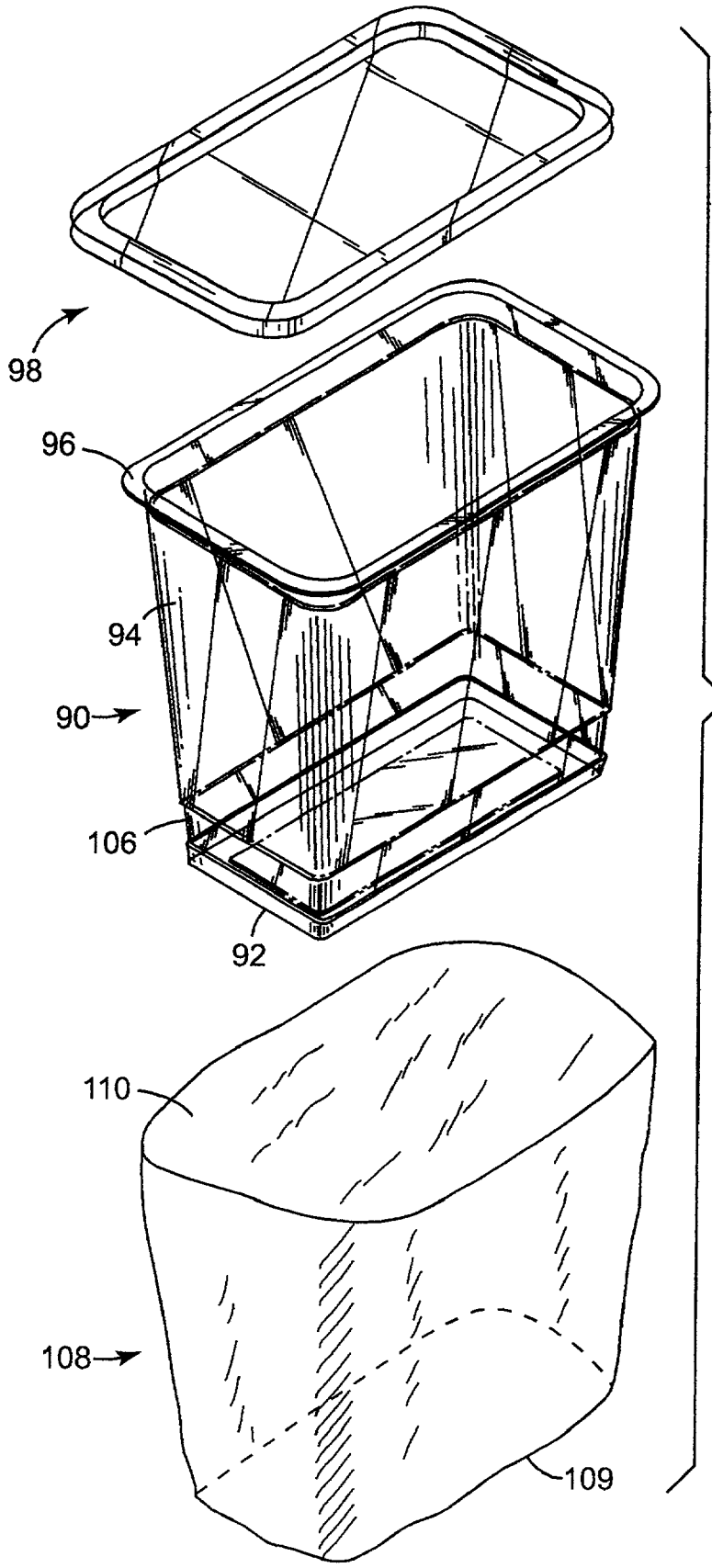
FIG. 12 is an exploded perspective view of the container of FIG. 10, also illustrating the lid and shrinkwrap layer therefor.

A third container embodiment is depicted in FIGS. 9-12, wherein container 90 has a substantially rectangular bottom 92 and four substantially flat side walls 94, which taper from top to bottom. As with the previously described embodiments, container 90 shown in FIGS. 9-12 includes a rim 96 which defines the periphery of container 90. As shown in FIGS. 11 and 12, but omitted from FIG. 9 for clarity, container 90 includes a lid 98 which covers container 90 and engages rim 96. As seen in FIG. 11, lid 98 includes a resilient C-shaped ledge 100 which wraps around and releasably engages mating ledge 102 defined by rim 96 of container 90. As shown in FIG. 9, bottom 92 of container 90 includes a raised rectangular mound 104 which allows several containers 90 to be nested and adds structural integrity to the container body. The surface discontinuity of container 90 is shown as ridge 106, which is essentially a continuous indentation that extends around the lower portion of the side walls 94 of container 90. Turning now to FIG. 11, shrinkwrap layer 108 totally envelops lid 98 and container 90, except container bottom 92. Instead of a tube shape as described with reference to previous embodiments, shrinkwrap layer 108 is essentially bag-shaped with an open bottom 109 and closed top 110 as shown in FIG. 12. Thus, when shrinkwrap layer 108 is formed to container 90, it totally covers lid 98 as shown in FIG. 11. As with the substantially square container 30 of FIGS. 1-4, ridge 106 of container 90 maintains shrinkwrap layer 108 in place against tapered side walls 94 even after shrinkwrap 108 is torn from the top of container 90.

Figure 13:
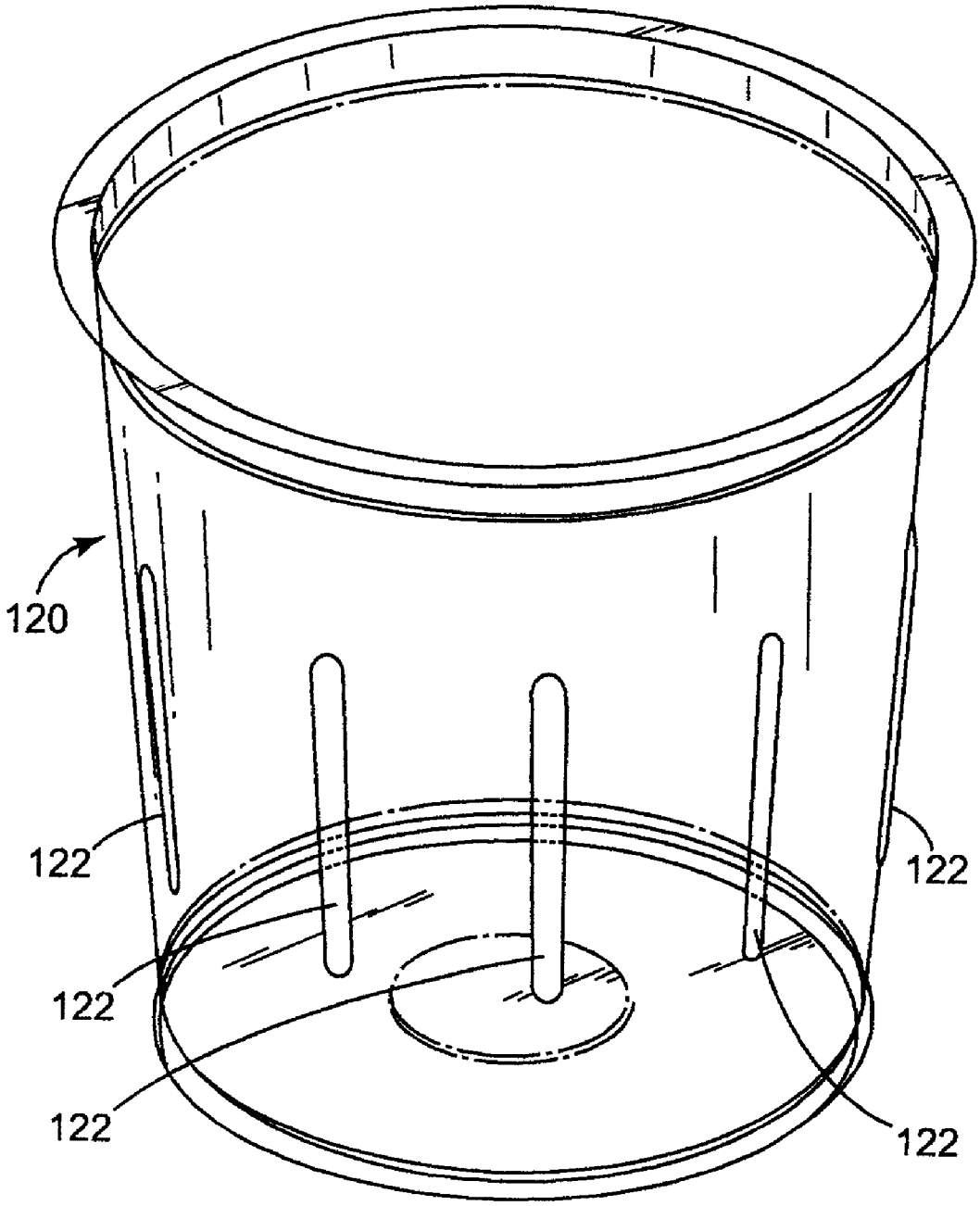
FIGS. 13-16 are perspective views of containers similar to that depicted in FIG. 5, illustrating alternate embodiments of the surface discontinuity disposed on the side wall of the container.
Figure 14:
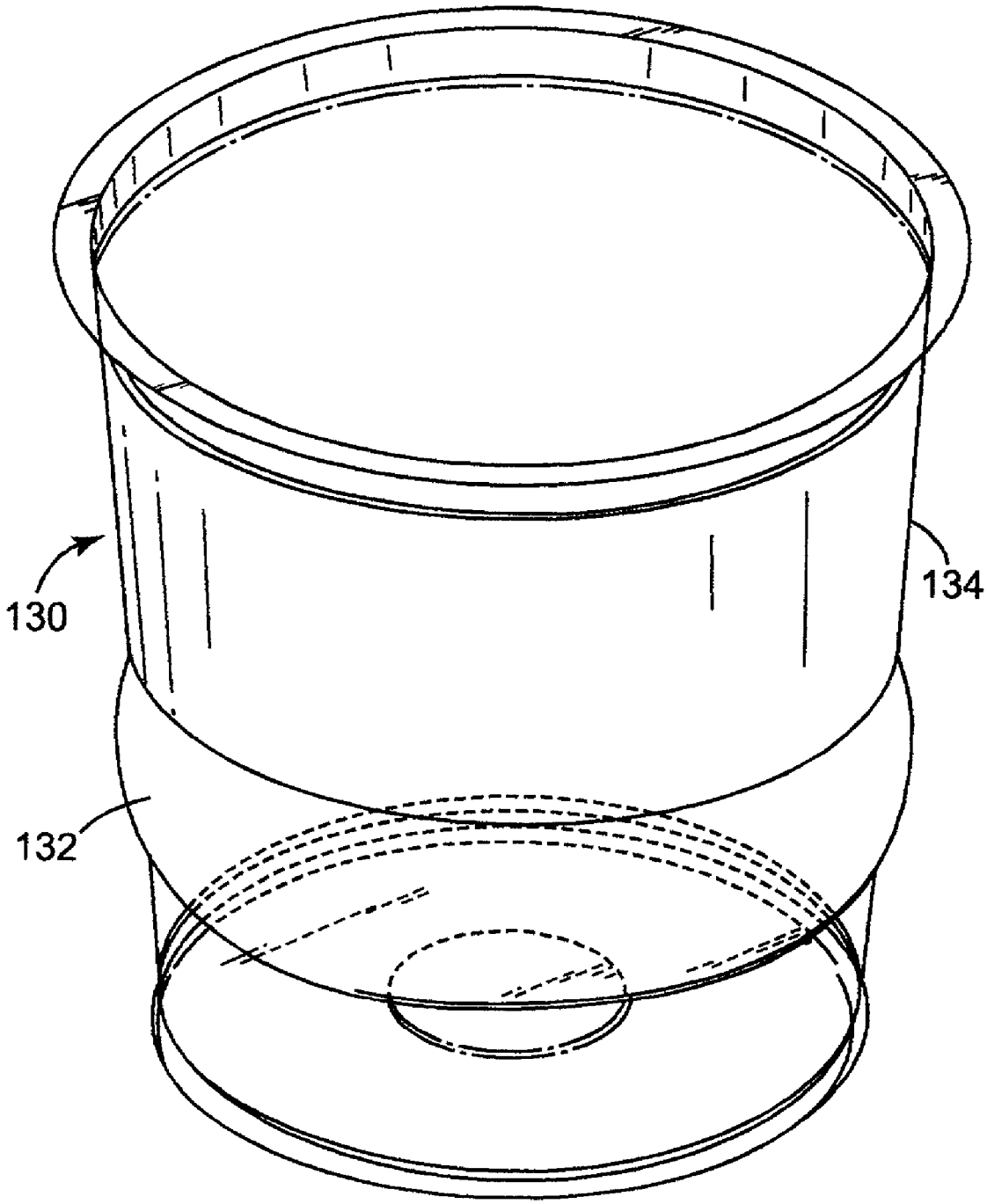
Figure 15:
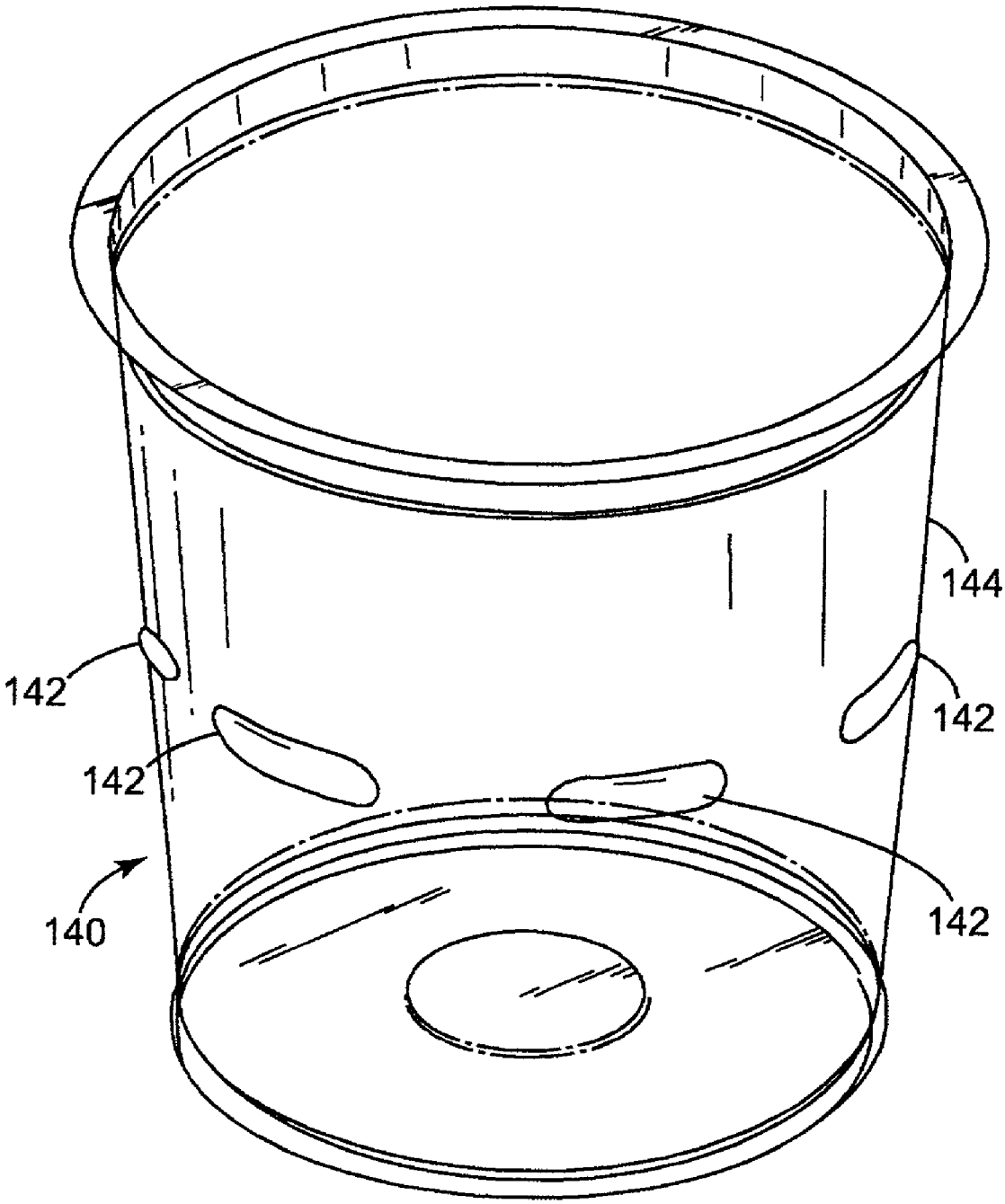
Figure 16:
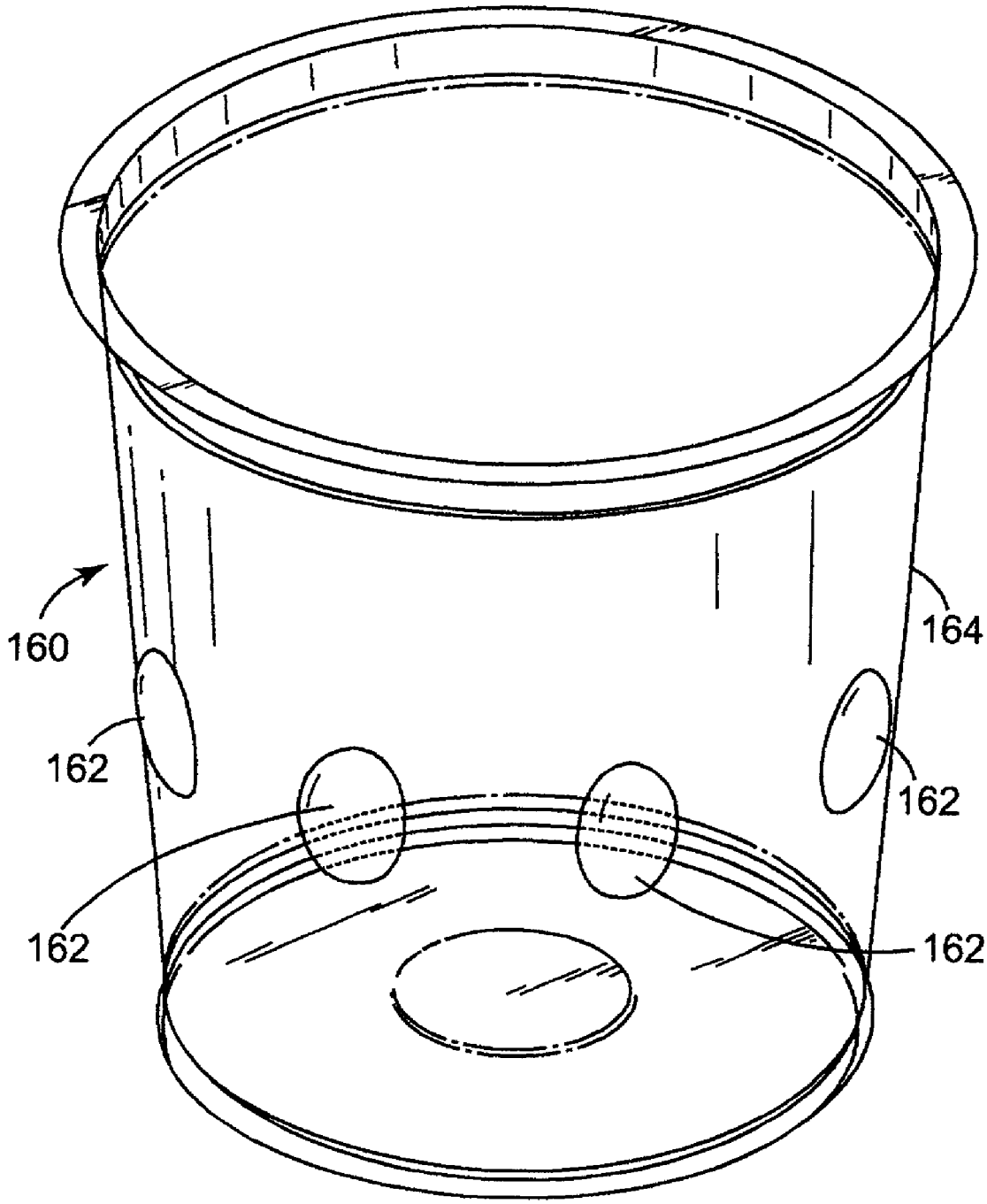

As alluded to above, the surface discontinuity in accordance with the present invention may take a variety of forms. For example, with reference to FIG. 13, container 120 includes a plurality of popsicle-shaped indentations to which the shrinkwrap layer conforms. Similarly, with reference to FIG. 14, the surface discontinuity takes the form of bulge 132 extending entirely around the side wall 134 of container 130. In container 140 shown in FIG. 15, the surface discontinuity is a series of horizontally oriented protuberances disposed on side wall 144. Container 160 shown in FIG. 16 illustrates a series of round protuberances 162 disposed along side wall 164. It can be thus readily recognized that one of ordinary skill in the art may fashion many other alternatives for the surface discontinuity in accordance with the present invention. Any number of surface discontinuity configurations will serve the objective of causing the shrinkwrap layer to cling to the side wall(s) of the container after it is torn from the top.

Figure 17:
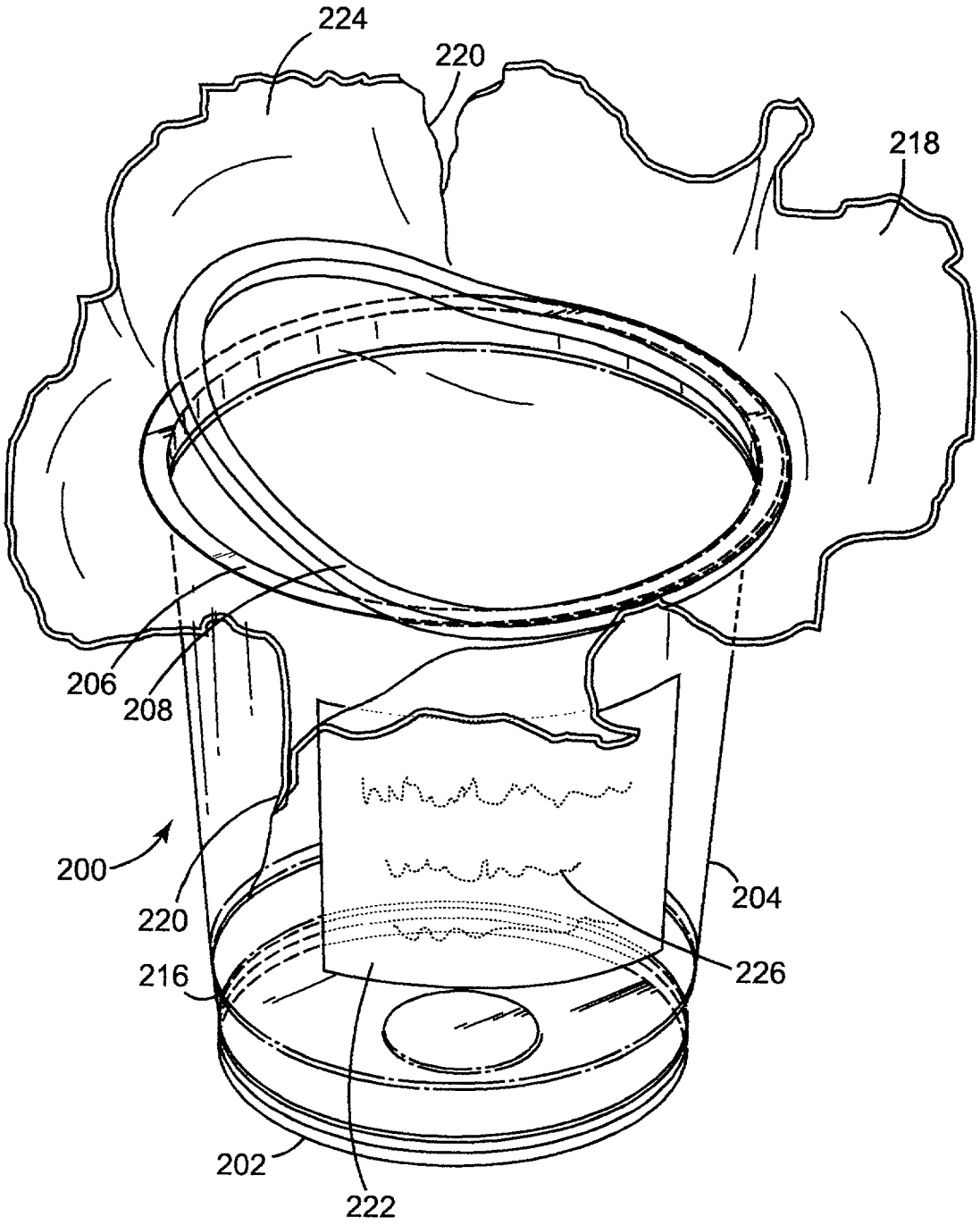
FIG. 17 is a perspective view of a container like the one shown in FIG. 5, from which the shrinkwrap has been torn and separated from the container lid and rim, yet nonetheless adheres to the side wall of the container.

Turning now to FIG. 17, the advantages of embodiments incorporating the present invention can be appreciated. Container 200 has a substantially round or circular bottom 202 from which side wall 204 upwardly extends and terminates in rim 206. Lid 208, shown partially open, releasably engages rim 206 as has been described above with reference to the embodiments depicted in FIGS. 1-4, 5-8 and 9-12. The surface discontinuity takes the form of ridge 216 disposed on the lower portion of side wall 204. Shrinkwrap layer 218 shown in FIG. 17 is partially torn and separated from the top of container 200 such that lid 208 can be opened. One of the tears 220 originates at the top of shrinkwrap layer 218 and extends down side wall 204 as shown.

Advantageously, even though shrinkwrap layer 218 has been substantially separated from lid 208 and rim 206 so that container 200 can be opened, shrinkwrap layer 218 nonetheless clings to tapered side wall 204. Thus, label 222 is maintained in place by shrinkwrap layer 218 after the container is opened. If a label be placed between the shrinkwrap layer and side wall, the interfaces between label 222 and side wall 204, and between label 222 and shrinkwrap layer 218 need not include any adhesive. Indeed, avoiding adhesives advantageously allows use of a lower cost label. Further, the label may be affixed to the outside of the shrinkwrap layer, if desired, since the shrinkwrap layer in accordance with the present invention will not fall from the container once the container is opened and the shrinkwrap is torn. This is advantageous, for example, when label 222 contains cooking instructions 226 that might be lost or discarded if the label became detached from the container, or if the label were affixed to the shrinkwrap and the shrinkwrap fell from the container and was discarded after the container was originally opened.

Further advantageously, if the shrinkwrap layer initially covers the entire lid after packaging, as is the case in container 200 shown in FIG. 17, the excess or overhang portion 224 of shrinkwrap layer 218 can be replaced over lid 208 to help reseal container 200 after it has been initially opened. Such is useful, for example, when food items are packaged in container 200 but there are "leftovers" after a single use. By contrast, in prior art embodiments, because the shrinkwrap layer falls from the side walls after it is initially torn from the top, the original shrinkwrap usually is discarded. In low cost containers such as the one shown in FIG. 17, a more effective seal is obtained by having the outer periphery of the lid and container sealed by shrinkwrap. Thus, in prior art containers, either the seal of the container after first use is not as effective because the shrinkwrap has been discarded, or the user must wastefully provide a new sheet of plastic wrap to effectively reseal the container.

As can now be appreciated, the present invention provides a simple method of sealing a container with shrinkwrap such that the shrinkwrap will cling to the tapered side walls of the container, without adhesive, after the shrinkwrap is substantially separated from the container lid and rim. The method includes providing a container having a bottom, at least one side wall, an open rim and a lid that releasably engages the rim. A surface discontinuity, taking any of the forms described above or as can be envisaged by one of ordinary skill, is formed on the container side wall. The shrinkwrap layer is then shrunk to the container by conventional means such that it envelops at least a portion of the side wall and the lid. The layer of shrinkwrap covers the surface discontinuity and conforms to the shape thereof. Because of the surface discontinuity, the user can tear the shrinkwrap layer such that a tear in the shrinkwrap extends down the side wall and the shrinkwrap layer is substantially separated from the container lid and rim so that the lid can be opened or removed. Nonetheless, the shrinkwrap substantially clings to the side wall. Further, if an adhesive-free label is placed against the side wall before shrinking the shrinkwrap layer, the label will be held in place by the shrinkwrap even after the container is opened. Alternatively, a label can be adhesively affixed to the outside of the slap layer as one of the final packaging steps, if desired.

Other embodiments of this invention will be apparent to those skilled in the art upon consideration of this specification or from practice of the invention disclosed herein. Various omissions, modifications, and changes to the principles and embodiments described herein may be made by one of ordinary skill in the art without departing from the true scope and spirit of the invention which is indicated by the following claims.

What is claimed is:

1. A method of opening a container for storing items comprising the steps of:

a) providing a nestable container, wherein the container comprises:

a container bottom;

a side wall extending upward from said bottom and terminating in a rim defining the periphery of said container, said side wall tapering from top to bottom such that the container can nest with one or more like containers when lids are not covering the containers;

a lid releasably covering said container;

an annular surface discontinuity disposed on said side wall intermediate said rim and said container bottom;

a tubular layer of shrinkwrap enveloping said tapered side wall and an outer periphery of the lid thereby securing the lid to the side wall; said shrinkwrap being separable from the lid and rim; and a non-adhesive label trapped between the shrinkwrap and the side wall; and b) separating the shrinkwrap from the lid and rim while said layer of shrinkwrap is formed to and covers said surface discontinuity and conforms to the shape of the surface discontinuity thereby holding the enveloping shrinkwrap in place on the sidewall when the lid is removed while the non-adhesive label is trapped between the shrinkwrap and the side wall, said label remaining trapped after the lid is removed.

2. The method of claim 1, further comprising the step of adhesively affixing a label to the outside of said shrinkwrap layer about said side wall.

3. The method of claim 1, wherein said shrinkwrap layer comprises an integral piece of shrink wrap.

4. The method of claim 1, wherein said shrinkwrap layer totally covers said lid.

5. The method of claim 1, wherein said surface discontinuity comprises an indentation.

6. The method of claim 5, wherein said indentation is proximal to the container bottom.

7. The method of claim 1, wherein said surface discontinuity comprises a plurality of indentations disposed on said side wall.

* * * * *